US008496138B2

(12) United States Patent
Gehman

(10) Patent No.: US 8,496,138 B2
(45) **Date of Patent: *Jul. 30, 2013**

(54) FLUID DISPENSING APPARATUS AND METHOD

(75) Inventor: Michael Chad Gehman, Barto, PA (US)

(73) Assignee: Dresser, Inc., Addison, TX (US)

( * ) Notice: Subject to any disclaimer, the term of this patent is extended or adjusted under 35 U.S.C. 154(b) by 343 days.

This patent is subject to a terminal disclaimer.

(21) Appl. No.: 12/884,642

(22) Filed: Sep. 17, 2010

(65) Prior Publication Data

US 2011/0089190 A1 Apr. 21, 2011

Related U.S. Application Data

(60) Provisional application No. 61/243,401, filed on Sep. 17, 2009.

(51) Int. Cl.
*B67D 7/12* (2010.01)

(52) U.S. Cl.
USPC ..... 222/74; 222/1; 222/75; 222/146.2; 222/529; 222/530; 222/538

(58) Field of Classification Search
USPC ..... 222/1, 74, 75, 530, 538
See application file for complete search history.

(56) References Cited

U.S. PATENT DOCUMENTS

| | | | | |
|---|---|---|---|---|
| 1,893,972 A | | 1/1933 | Whitman | |
| 2,150,025 A | | 3/1939 | Cook, Jr. et al | |
| 3,487,850 A | | 1/1970 | Wahler et al. | |
| 4,557,436 A | | 12/1985 | Drake | |
| 5,083,846 A | | 1/1992 | Day et al. | |
| 5,110,010 A | * | 5/1992 | Smith | 222/75 |
| 5,373,120 A | * | 12/1994 | Barrett et al. | 187/316 |
| 5,867,403 A | | 2/1999 | Sasnett et al. | |
| 6,149,033 A | * | 11/2000 | Poleshuk | 222/75 |

(Continued)

FOREIGN PATENT DOCUMENTS

| | | |
|---|---|---|
| DE | 8708333 | 6/1987 |
| DE | 202007012316 U1 | 12/2007 |

(Continued)

OTHER PUBLICATIONS

Tokheim, "Quantium T series AdBlue—Dispensing Success The World Over" (4 pages).

(Continued)

*Primary Examiner* — Kevin P Shaver
*Assistant Examiner* — Christopher Bahr
(74) *Attorney, Agent, or Firm* — Hiscock & Barclay LLP

(57) ABSTRACT

A fluid dispenser includes a control module and a hose module. The hose module includes a housing and at least a portion of a fluid hose within an interior volume of the housing, a fluid nozzle supported by a boot when enclosed within the housing; a first door allowing removal of the fluid nozzle from the boot through a first opening created when the first door is adjusted from a closed position to an open position; a second door adjacent the exterior of the housing and adjustable from a shut position to a retracted position, where the second door allows access to the fluid hose when the second door is in the retracted position; and a linear motor adapted to adjust the second door from the shut position to the retracted position based on a received signal indicating the first door in the open position.

26 Claims, 10 Drawing Sheets

U.S. PATENT DOCUMENTS

| | | | | |
|---|---|---|---|---|
| 6,328,060 | B1 | 12/2001 | Smith | |
| 6,334,457 | B1 | 1/2002 | Baker, IV | |
| 7,254,463 | B1 | 8/2007 | Moore | |
| 7,925,375 | B2 * | 4/2011 | Schininger et al. | 700/214 |
| 8,104,641 | B2 * | 1/2012 | Gehman | 222/74 |
| 2007/0262847 | A1 * | 11/2007 | Grabinger et al. | 340/3.1 |
| 2009/0034232 | A1 * | 2/2009 | Larsson et al. | 362/96 |
| 2010/0050524 | A1 * | 3/2010 | Helms | 49/26 |
| 2010/0252571 | A1 | 10/2010 | Gehman | |
| 2011/0089190 | A1 | 4/2011 | Gehman | |

FOREIGN PATENT DOCUMENTS

| | | | |
|---|---|---|---|
| DE | 202007012316 | * | 1/2008 |
| EP | 1113979 | | 6/2002 |
| EP | 1243549 | A | 9/2002 |
| EP | 1331200 | | 7/2003 |
| EP | 1398294 | A1 | 3/2004 |
| EP | 1845057 | | 8/2008 |
| WO | WO 00/61490 | A1 | 10/2000 |
| WO | WO 2011/035115 | | 3/2011 |

OTHER PUBLICATIONS

Gilbarco Veeder-Root, "SK700 AdBlue—The Smart AdBlue Fuelling Station," copyright 2006 (2 pages).

Dresser Wayne Pignone, "AdBlue® fuel dispensers: New technology for an emerging market" (2 pages).

International Search Report and Written Opinion for PCT/US2010/049269 dated Dec. 30, 2010, 9 pages.

European Search Report for EP 06112475.6 dated Nov. 24, 2006 (6 pages).

* cited by examiner

FLUID DISPENSING APPARATUS AND METHOD

CLAIM OF PRIORITY

This application claims priority under 35 U.S.C. §119(e) to U.S. Provisional Patent Application Ser. No. 61/243,401, filed on Sep. 17, 2009, the entire contents of which are hereby incorporated by reference in their entirety.

TECHNICAL FIELD

This disclosure relates to fluid dispensing and, more particularly, to fluid dispensing at a fueling environment by a fluid dispenser with multiple doors.

BACKGROUND

Fueling environments, such as commercial or fleet fueling stations, convenience stores, retail fueling stations, and large consumer retailers, typically include one or multiple fluid dispensers. Such fluid dispensers are most often fuel dispensers, operated by the consumer to dispense fuel (e.g., gasoline, biofuels, diesel) into a variety of vehicles. The exemplary fueling environments, however, often include other types of fluid dispensers that consumers require to maintain their vehicles. For example, fueling environments often include dispensers for water and air in order for consumers to maintain the coolant and tire systems, respectively, on their vehicles. In certain types of vehicles, such as vehicles designed to operate on diesel fuel or biodiesel, additional fluids may be required to properly operate and maintain the vehicles. For example, a diesel-powered vehicle may typically require additional fluids to provide for acceptable and lawful operation of an emissions system of the vehicles.

Selective Catalytic Reduction (SCR) is an emissions system typically used in diesel vehicles to reduce $NO_x$ emissions. In an SCR system, aqueous urea may be sprayed directly into the vehicle exhaust stream, creating ammonia gas. Through a catalytic converter, the ammonia combines with the $NO_x$ gasses to convert such gases into nitrogen and water. This emissions solution has been employed in Europe for several years, where the aqueous urea solution is often referred to as "AdBlue." In some instances, use of SCR systems may be dictated by regulatory requirements, such as government emission standards designed to limit an amount of emissions acceptably expelled from a diesel vehicle.

SCR systems in the United States typically employ Diesel Exhaust Fluid (DEF), which is often used as a generic name for the aqueous urea solution. In some vehicles, such as, for example, diesel trucks, a separate DEF storage tank may be maintained on the truck and must be refilled regularly. For a variety of reasons, including convenience, fueling environments may include both fuel dispensers and DEF dispensers on the premises. DEF dispensers are often designed to account for the chemical characteristics of the aqueous urea solution (DEF). Further, since DEF is typically a 32.5% solution of chemically pure urea in deionized water, its freezing point is approximately 12° F. (−11° C.). Various components of the DEF dispenser may therefore be more easily susceptible to damage from freezing conditions.

Several solutions to the challenge of maintaining DEF dispensers in environmentally-challenging climates have been employed. For instance, some solutions include merely enclosing the DEF dispenser components in a housing with a simple hinged door allowing access to such components. Such solutions, however, often suffer from several disadvantages, including the possibility of significant abuse and damage to the door in fueling environments. Further, there is no assurance the door will be closed after use, negating any climate-control effects of the DEF dispenser housing. Another solution includes the use of electrically-operated automatic doors allowing access to the components of the DEF dispenser. While such doors may solve the problem of accidental non-closure, they often have operational problems in fueling environments that are often abusive to equipment. Yet another solution includes completely enclosing the DEF dispenser components within an enclosure, allowing only certain components, for example a dispensing nozzle and hose, to be removed from the enclosure. Such a solution often requires constant tension to be placed on the hose, urging it back into the enclosure. Thus, a fueling consumer must always wrestle with the hose under tension and there could be problems drawing hose accessories, for instance a breakaway, into the cabinet. Another solution includes a dispenser housing with multiple openings, allowing access to the nozzle and hose, respectively. The hose opening, however, is usually protected by interlocking brushes, which may help keep heat within the enclosure while allowing the hose to pass through the opening. Such a design, however, does not totally seal the enclosure against the loss of thermal energy to the environment. Further, the brushes often hamper a user as she attempts to extend the hose from the cabinet.

SUMMARY

In one general embodiment, a fluid dispenser includes a control module operable to receive at least one command to dispense a fluid and, in response to the command, dispense fluid through a fluid nozzle; and a hose module. The hose module includes a housing adapted to enclose the fluid nozzle and at least a portion of a fluid hose within an interior volume of the housing, the fluid nozzle supported by a boot when enclosed within the housing; a first door located adjacent an exterior of the housing and allowing removal of the fluid nozzle from the boot through a first opening created when the first door is adjusted from a closed position to an open position; a second door adjacent the exterior of the housing and adjustable from a shut position to a retracted position, where the second door allows access to the fluid hose when the second door is in the retracted position; and a linear motor adapted to adjust the second door from the shut position to the retracted position based on a received signal indicating the first door in the open position.

In another general embodiment, a method for dispensing fluid with a fluid dispenser having a control module and a hose module including a housing enclosing at least a portion of a fluid conduit, a first door, a second door, and a linear motor includes the steps of: receiving a command at the control module to commence fluid dispensing; generating an electrical signal based on at least one of the first door adjusted from a shut position to an open position and a fluid nozzle enclosed within the housing being supported by a boot, the boot adapted to support the nozzle in an interior volume of the housing; energizing the linear motor based on the electrical signal; and operating the linear motor to adjust the second door from a shut position to a retracted position, the portion of the fluid conduit extendable from the housing when the second door is in the retracted position.

In some aspects of one or more general embodiments, the linear motor may be adapted to adjust the second door from the shut position to the retracted position based on one or more received signals indicating the first door in the open position and the nozzle removed from the boot.

In some aspects of one or more general embodiments, the linear motor may be adapted to adjust the second door from the retracted position to the shut position based on a second received signal indicating the first door in the closed position and the fluid nozzle supported by the boot.

In some aspects of one or more general embodiments, the linear motor may be a first linear motor, and the hose module may further include a second motor and a third door adjacent the exterior of the housing and adjustable from a shut position to a retracted position, where the third door allows access to the fluid hose when the third door is in the retracted position. The second motor may be adapted to adjust the third door from the shut position to the retracted position based on the received signal indicating at least one of the first door in the open position and the fluid nozzle removed from the boot.

In some aspects of one or more general embodiments, the first and second motors may be one linear motor.

In some aspects of one or more general embodiments, at least one of the first, second, and third doors may be a portion of the exterior of the housing.

In some aspects of one or more general embodiments, the linear motor may be a linear actuator assembly.

In some aspects of one or more general embodiments, the hose module may further include a first switch coupled to the first door and communicably coupled to the linear motor, where the first switch is adapted to generate a first signal indicating adjustment of the first door from the closed position to the open position.

In some aspects of one or more general embodiments, the hose module may further include a second switch coupled to the boot and communicably coupled to the linear motor, where the second switch is adapted to generate a second signal indicating removal of the nozzle from the boot.

In some aspects of one or more general embodiments, the received signal may be at least one of the first and second generated signals.

In some aspects of one or more general embodiments, the dispenser may further include a controller communicably coupled to at least one of the first and second switches and the linear motor.

In some aspects of one or more general embodiments, the controller may be adapted to receive at least one of the first and second generated signals and transmit the received signal to the linear motor.

In some aspects of one or more general embodiments, the controller may be adapted to maintain the transmission of the received signal to the motor based on substantially continuous receipt of at least one of the first and second signals.

In some aspects of one or more general embodiments, the controller may be adapted to discontinue transmission of the received signal to the linear motor based on discontinuation of at least one of the first and second signals.

In some aspects of one or more general embodiments, the linear motor may be adapted to adjust the second door from the retracted position to the shut position based on discontinuation of the transmission of the received signal to the linear motor.

In some aspects of one or more general embodiments, the controller and the control module may be the same.

In some aspects of one or more general embodiments, the fluid hose may be adapted to carry a fluid such as an aqueous urea solution.

Some aspects of one or more general embodiments may include the features of: generating a second electrical signal based on at least one of the first door being adjusted from the open position to the shut position and the nozzle supported in the boot; energizing the linear motor, based on the second electrical signal; and operating the linear motor to adjust the second door from the retracted position to the shut position.

Some aspects of one or more general embodiments may include the features of: generating, by the first switch, a first signal indicating adjustment of the first door from the closed position to the open position.

Some aspects of one or more general embodiments may include the features of: generating, by the second switch, a second signal indicating removal of the nozzle from the boot.

Some aspects of one or more general embodiments may include the features of: receiving, at the linear motor, the electrical signal, may include receiving, at the linear motor, at least one of the first and second generated signals.

Some aspects of one or more general embodiments may include the features of: receiving at least one of the first and second generated signals at the controller; and transmitting the electrical signal to the motor from the controller based on receipt of the at least one of the first and second generated signals.

Some aspects of one or more general embodiments may include the features of: maintaining the transmission of the electrical signal to the linear motor based on substantially continuous receipt of at least one of the first and second signals.

Some aspects of one or more general embodiments may include the features of: discontinuing transmission of the electrical signal to the linear motor based on discontinuation of the at least one of the first and second signals.

Some aspects of one or more general embodiments may include the features of: operating the linear motor to adjust the second door from the retracted position to the shut position based on discontinuation of the transmission of the electrical signal to the linear motor.

Various embodiments of a fluid dispenser utilizing a hose module according to the present disclosure may have one or more of the following features. For example, the fluid dispenser may include one or more self-closing doors to effectively enclose the dispenser components in a climate-controlled housing. The fluid dispenser may permit sealing an entire nozzle and hose assembly for environmental conditioning. The fluid dispenser may include one or more doors able to be stored in a retracted interior position for times of the year and climates when environmental conditioning may not be required or desirable. Further, the fluid dispenser may include an initial length of substantially tension-free hose that may be removed and returned freely within the fluid dispenser enclosure. The fluid dispenser may also include an additional portion of hose available under tension for longer hose access from the fluid dispenser.

Various embodiments of the fluid dispenser utilizing the hose module according to the present disclosure may also have one or more of the following features. The fluid dispenser may utilize a simpler and more reliable design that is able to withstand abusive fueling environments. Further, the fluid dispenser may be applicable to both domestic and foreign jurisdictions with little to no modification. The fluid dispenser may also be applicable for a variety of fluids where climate control is a concern, such as an aqueous urea solution (DEF or AdBlue), biodiesel, or other organic fuel. The fluid dispenser may also include a sealed or substantially sealed housing for the components of the dispenser. As another example, the fluid dispenser may include multiple doors mechanically coupled such that all of the doors may be opened to allow access to the dispenser components through the opening of a single door. The fluid dispenser may also include automatically closing doors such that each door shuts to environmentally seal the dispenser after use of the dispenser.

These general and specific aspects may be implemented using a device, system, or method, or any combinations of devices, systems, or methods. The details of one or more embodiments are set forth in the accompanying drawings and the description below. Other features will be apparent from the description and drawings, and from the claims.

DETAILED DESCRIPTION

A fluid dispenser according to the present disclosure includes a hose module to more effectively and efficiently manage and protect one or more components for fluid dispensing. The fluid dispenser, in some embodiments, may be utilized to dispense an aqueous urea solution, such as DEF or AdBlue, into a diesel vehicle or storage tank. The dispenser, however, may generally be used to dispense any fluid, particular fluids that may be adversely affected by atmospheric conditions (e.g., heat, cold, humidity), which may be encountered in the environment within which they are installed. The hose module includes a housing to enclose a nozzle, a fluid hose, and other various components of the fluid dispenser. A nozzle door is mounted substantially flush with the exterior of the housing and may be opened to allow access to the nozzle. By adjusting the nozzle door to allow access to the nozzle (i.e., to an open position), one or more hose doors may automatically open to allow the fluid hose to be freely extended from the hose module (i.e., to a retracted position).

Figure 1:
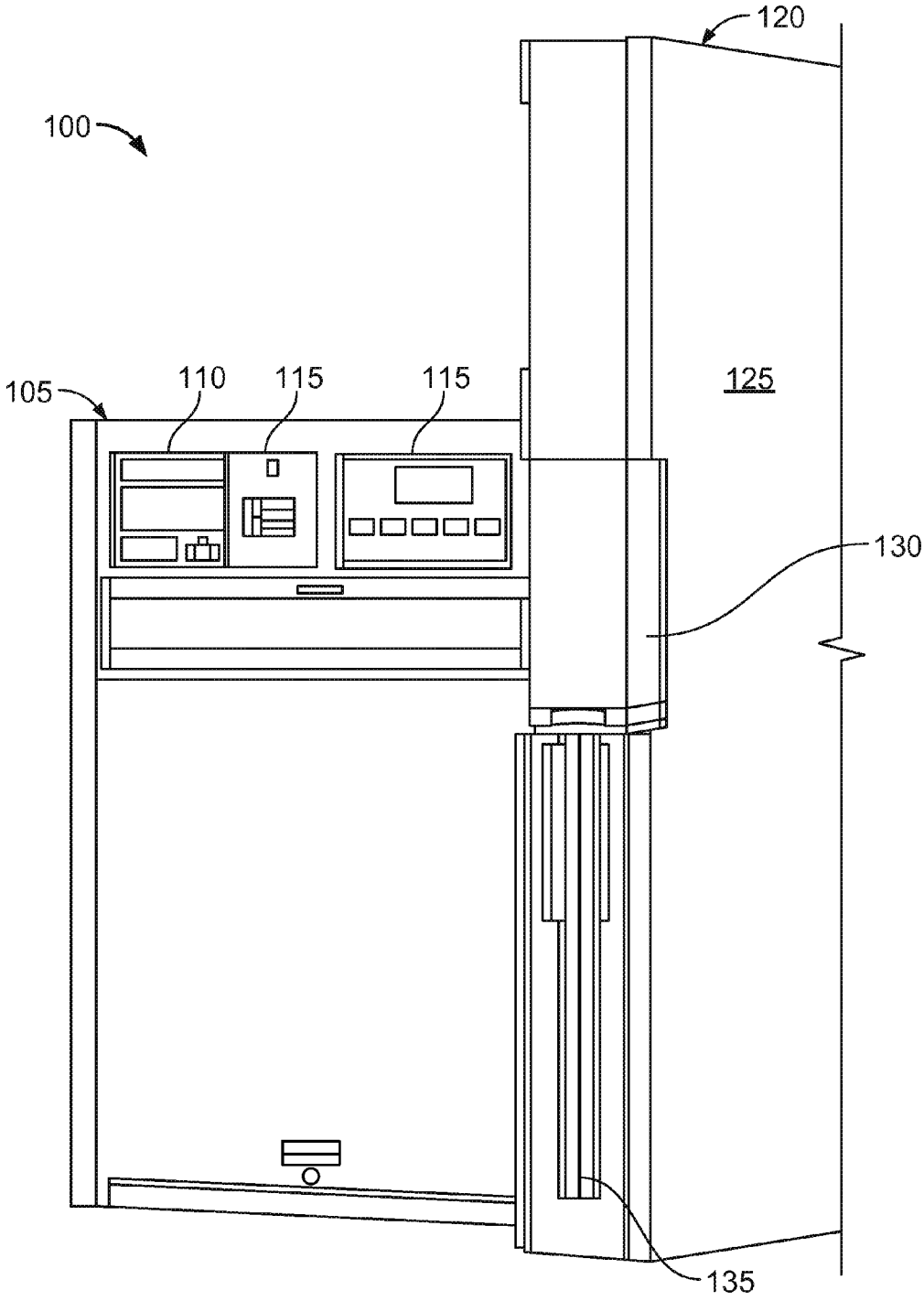
FIG. 1 illustrates one embodiment of a fluid dispenser including a hose module according to the present disclosure.

FIG. 1 illustrates a fluid dispenser 100 including a hose module 120. Generally, the fluid dispenser 100 facilitates one or more fluid dispensing transactions and operations. The fluid dispenser 100 may be located at any appropriate fueling facility (not shown), such as a gas station environment, a convenience store environment, "big box" consumer store, fleet fueling facility, or corporate fueling facility. In addition, the fluid dispenser 100 may be located and utilized apart from a fueling facility, such as at a DEF or AdBlue dispensing facility. Fluid dispenser 100, in some embodiments, controls, facilitates, or otherwise manages the dispensing of an aqueous urea solution used in diesel-powered vehicles, such as DEF or AdBlue. In some embodiments, however, fluid dispenser 100 may be utilized to dispense any other appropriate fluid that may be climate-controlled or otherwise environmentally protected, such as biodiesel or other organic fuel. For example, fluid dispenser 100 may be utilized to dispense fluids having a freezing- or gel-point greater than 0° F. (−18° C.).

Fluid dispenser 100 may typically operate in cooperation with one or more additional fluid dispensers at the fueling facility. In doing so, fluid dispenser 100 may recognize when a customer is present (e.g., by detecting activation of an input device or removal of a nozzle) and notify the fueling facility, which may then obtain payment information from the customer, authenticate the customer, and allow fluid dispensing to begin. The fluid dispenser 100 may also communicate the dispensed amount of fluid to a fueling facility controller, which may complete the sales transaction when the customer is finished dispensing the fluid. The fluid dispensers may, however, operate independently of the facility controller and/or a store interface unit for certain tasks and/or periods of time, when appropriate.

Fluid dispenser 100 may communicate with the fueling facility through a variety of techniques. For instance, communication may be by wireline (e.g., IEEE 802.3 or RS-232), wireless (e.g., IEEE 802.11, CDMA 2000, or GPRS), or optical (e.g., FDDI or SONET). A communication network facilitating such communication may include one or more components, such as hubs, routers, switches, bridges, repeaters, multiplexers, and transceivers. In particular embodiments, the communication network may operate by a combination of communication techniques. As such, the communication network may be coupled to fluid dispenser 100, one or more additional fluid dispensers, one or more fuel dispensers, and the fueling facility by communication links including wireline (e.g., twisted pair wire or coaxial cable), wireless (e.g., radio frequency (RF) or infrared (IR)), optical (e.g., fiber-optic cable), and/or any other appropriate path for conveying information. In particular embodiments, the communication links may include a combination of communication link types (e.g., wireline and wireless).

Fluid dispenser 100 includes a control module 105, a controller 110, one or more user devices 115, and the hose module 120. Generally, control module 105 and hose module 120 consist of separate enclosures connected together to form an integral fluid dispenser 100. In some embodiments, however, the control module 105 and hose module 120 may be standalone modules communicably coupled, or, in some aspects, the modules 105 and 120 may be formed as a single enclosure. In any event, the control module 105 and the hose module 120 function together to allow fluid dispensing from the fluid dispenser 100. Thus, the present disclosure contemplates that one or more components or portions of the control module 105 and the hose module 120 may be manufactured, tested, sold, or installed separate from each other.

In some embodiments, one or more portions of the fluid dispenser 100 may be incorporated into, integrated with, or otherwise coupled to a fuel dispenser at the fueling facility, such as a diesel fuel dispenser. For instance, the hose module 120 may be incorporated into a diesel fuel dispenser at the fueling facility as an additional module to the fuel dispenser. Thus, customers may dispense both diesel fuel and, for example, DEF fluid from a single dispenser. In some embodiments of the combined fuel and fluid dispenser, the fuel hose and nozzle may not need additional environmental protection while the fluid hose and nozzle may need such protection, such as, for example, one or more of the nozzle door 130 and the hose doors 135, described more fully below.

In some embodiments, an exterior shell of the control module 105 and/or the hose module 120 may be formed of corrosion resistant material, such as aluminum, stainless steel, or other appropriate material. For instance, in some embodiments of the fluid dispenser 100 used to dispense DEF, a housing 125 of the hose module 120 and one or more components of the hose module 120 (described below with reference to FIG. 2) may be formed of anodized aluminum due to, for instance, the chemical properties of DEF. Further, in some aspects, some or all of the housing 125 may be insulated.

The control module 105 controls the dispensing of fluid from fluid dispenser 100. To accomplish this, control module 105 may control the hydraulic elements of the dispenser 100 necessary to carry out fluid dispensing operations. For example, control module 105 may control submersible pumps in fluid storage tanks and fluid control valves and monitor fluid flow information via metering and reporting sub-systems. Control module 105 may also track the volume of fluid dispensed totals by type, drive sale progress displays on the sales/volume displays, and monitor for errors.

Controller 110, generally, is responsible for managing the operations of fluid dispenser 100 and may be located in any appropriate location within or integral with the control module 105. To accomplish this, the controller 110 may control the electronic functions of fluid dispenser 100. The controller 110 may also collect and maintain status information regarding the fluid dispenser 100 and report the status information to the fueling facility. Controller 110 may be implemented in software, hardware, or a combination thereof. For example, the controller 110 may store in memory and execute one or more software applications written or described in any appropriate computer language including C, C++, Java, Visual Basic, assembler, Perl, any suitable version of 4GL, as well as others. Such applications may be executed by one or more processors located within or communicably coupled to the controller 110. Such processors execute instructions and manipulate data to perform the operations of the controller 110. Each processor may be, for example, a central processing unit (CPU), a blade, an application specific integrated circuit (ASIC), or a field-programmable gate array (FPGA). Although the present disclosure contemplates a single processor in controller 110, multiple processors may be used according to particular needs and reference to a single processor is meant to include multiple processors where applicable.

Controller 110 may further include one or more memory devices located therein or communicably coupled to the controller 110. In some embodiments, for example, such memory may be any database module and may take the form of volatile or non-volatile memory including, without limitation, magnetic media, optical media, random access memory (RAM), read-only memory (ROM), removable media, or any other suitable local or remote memory component. The memory may also include any other appropriate data such as print or other reporting files, HTML files or templates, data classes or object interfaces, and software sub-applications or sub-systems.

User devices 115 may be installed within the control module 105 or communicably coupled to the control module 105 and, typically, allow a customer or user to interact (e.g., receive information and requests for information, provide responses to requests for information, provide transaction data, such as payment data or identification data) with the fluid dispenser 100 prior to, during, and subsequent to fluid dispensing transactions. Generally, each of the user devices 115 is communicably coupled to the controller 110 and exchanges data with the controller 110. Although illustrated as two user devices 115, fewer or more user devices may be provided with the fluid dispenser 100, as appropriate.

Each user device 115 may be one or more interactive components. For instance, the user device 115 may be a keypad, a keyboard, a touchpad, a touch screen, a card reader, or any other appropriate device for allowing a user to provide an indication to the fuel dispenser. User device 115 may also be a customer display and allow a customer of the fluid dispenser 100 to receive visual or auditory data originating from the fluid dispenser 100, fueling facility, or third party location (e.g., payment card issuer). As a display, the user device 115 may be a cathode ray tube (CRT) monitor, a liquid crystal display (LCD) monitor, a gas-plasma monitor, a light-emitting diode (LED) display, or any other appropriate device for visually presenting information. In some embodiments, user devices 115 may work in concert with each other (e.g., the display may present instructions or data for the keyboard, keypad, or card reader and/or input from the keypad or card reader may correlate with data presented on the display).

The hose module 120, typically, encloses one or more components operable to dispense fluid upon initiation of a fluid dispensing transaction. Such components include, for instance, a nozzle and a fluid hose among other components (described below). At least a portion of the components of the hose module 120 may be enclosed within the housing 125. In some embodiments, the housing 125 may include an aperture within a bottom or side surface of the hose module 120. The aperture may allow access for connecting the fluid hose to the hydraulic dispensing equipment (e.g., pumps, valves, meters) located underground or otherwise remote from the fluid dispenser 100.

Hose module 120 also includes a nozzle door 130. The nozzle door 130, typically, provides an access location for the user of the fluid dispenser 100 to gain access to the nozzle of the dispenser 100. The nozzle door 130 may also at least partially seal the hose module 120 against the exterior environment (e.g., rain, snow, heat). As explained more fully with respect to FIGS. 2-4, nozzle door 130 may be vertically operated (e.g., moved up and/or down) for removal of the nozzle from the hose module 120. Alternatively, in some embodiments, the nozzle door 130 may be horizontally operated (e.g., moved side-to-side) to open and/or close. Further, in some embodiments, the nozzle door 130 may be hinged and rotatably adjusted to open and/or close.

Hose module 120 also includes one or more hose doors 135. The hose doors 135, typically, provide a sealable opening into the housing 125 of the hose module 120 and allow the hose enclosed therein to be removed from the housing 125. For instance, as explained more fully with respect to FIGS. 2-4, the hose doors 135 may be opened during the dispensing operation and automatically close upon, for example, replacement of a fluid nozzle into a nozzle boot. Further, in some embodiments, the hose doors 135 and/or the nozzle door 130 may be kept open (e.g., locked or latched) during periods of milder climates, such as, for example, when outside temperatures are well above the freezing- or gel-point of the fluid to be dispensed by the dispenser 100.

Figure 2:
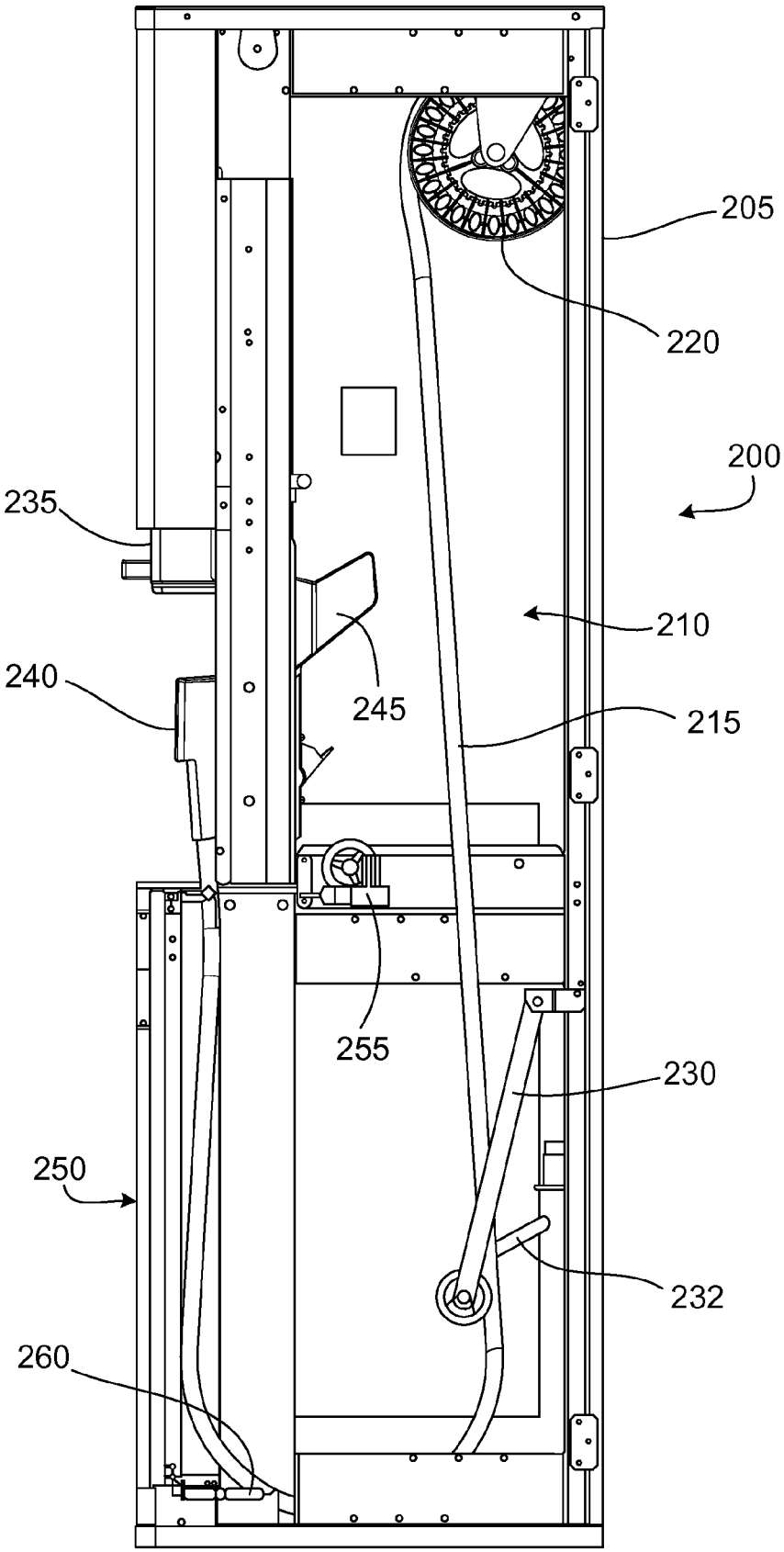
FIG. 2 illustrates a sectional view of one embodiment of a hose module with a nozzle door in an open position according to the present disclosure.

FIG. 2 illustrates a sectional view of one embodiment of a hose module 200 with a nozzle door 235 in an open position. In some embodiments, hose module 200 may be similar or substantially similar to the hose module 120 of the fluid dispenser 100 shown in FIG. 1. Hose module 200 includes a housing 205 enclosing a cavity 210, a nozzle door 235, one or more hose doors 250, a nozzle 240, a nozzle boot 245, and a fluid hose 215. The fluid hose 215 may also include a swivel (not shown), which may be coupled to the nozzle 240 and allow for single or dual-plane rotation of the nozzle 240 to make handling of the nozzle 240 easier for the user. The hose module 200 also includes a hose pulley 220, a hose arm 230, one or more linear motors 255, and one or more hose door springs 260.

As shown in FIG. 2, nozzle door 235 includes a handle and, typically, is slideable vertically along one or more tracks or slots (not shown) integral to the housing 205. Generally, the nozzle door 235 may be adjusted upward from a closed position, in which the door 235 substantially encloses the nozzle 240 within the housing 205, to the open position, illustrated in FIG. 2. Thus, in the open position, the nozzle door 235 may allow access for the customer or user to grasp the nozzle 240 and remove it from the nozzle boot 245. In some embodiments, opening of the nozzle door 235 may automatically open the hose doors 250. For example, in some embodiments, as described more fully below, opening the nozzle door 235 may signal the linear motor 255 to open the hose doors 250.

The hose doors 250, typically, are pivotable into the interior volume 210 to a retracted position thus allowing access to the fluid hose 215. For instance, each hose door 250 may engage a rotatable pin structure at the top and/or bottom of the door 250, thus allowing the door 250 to swing open when the nozzle door 235 is adjusted to the open position. As the hose doors 250 are typically opened automatically when the nozzle door 235 is opened, the hose doors 250 may not include any handles or graspable protrusions in some embodiments, thus providing a surface that may be slightly recessed. In some aspects, the slightly recessed surface of the hose doors 250 may allow for decreased damage to the hose module 200 in a fueling environment.

The nozzle 240 is in fluid communication with the fluid hose 215 and, typically, allows the consumer or user to dispense fluid into a vehicle, storage container, or other appropriate location while controlling a volumetric flow rate of the dispensed fluid. When not in use, the nozzle 240 may be stored in and supported by the boot 245 within the housing 205. In some embodiments, as explained below, one or more switches (e.g., magnetic switches) may be coupled within or to the boot 245 and activate when the nozzle 240 is removed and/or returned to the boot 245.

The fluid hose 215 is coupled to the nozzle 240 and is fluid communication with one or more fluid storage facilities, such as aboveground or underground storage tanks, and provides a closed path for fluid to be pumped from the storage facilities to the nozzle 240. For example, the fluid hose 215 may receive fluid, such as DEF, directly from such storage facilities or from such storage facilities and through other components, for example, a dispenser meter. Generally, the fluid hose 215 may be extended from the housing 205 through the retracted hose doors 250. The fluid hose 215 may then be returned to the interior volume 210 of the housing 205 through the hose doors 250 and stored therein.

In certain embodiments, a hose pulley 220 helps facilitate extension of the fluid hose 215 from the housing 205. A first portion of the fluid hose 215 may be freely extendable from the housing 205 while a second portion of the hose 215 coupled to the first portion may be under a tensile force urging the second portion into the housing 205. For example, the first portion of the hose 215 may be extended by the customer or user and, if necessary, the customer may then pull an additional amount of hose 215 from the housing 205 against the tensile force applied to the second portion of the hose 215. In some embodiments, the tensile force may be applied to the second portion of hose 215 by the hose pulley 220. For instance, one or more bungee cords may be connected between the housing 205 and the hose pulley 220, thereby returning the hose pulley 220 to its original position when the hose tension is released, and thus the second portion of hose 215 into the interior volume of the cabinet 210.

The hose arm 230 is coupled to the housing 205 and includes a pulley to engage the fluid hose 215. In some embodiments, the hose arm 230 rotates clockwise about a pivot upon extension of the hose 215, with the hose 215 engaged with the pulley of the arm 230. Upon returning of the hose 215 to the interior 210 (e.g., upon completion of fluid dispensing), the hose arm 230 may assist the hose 215 in returning to an enclosed position, as illustrated in FIG. 2. For example, the hose arm 230 may be coupled to the housing 205 (or other part of the module 200) by an elastomeric element 232 (e.g., spring, bungee cord). The elastomeric element 232 may exert a retractive force on the hose 215 via the hose arm 230, thereby urging the hose 215 into its enclosed position. Alternatively, in some embodiments, the elastomeric element 232 may be eliminated and the hose arm 230 may help urge the hose 215 to the enclosed position through a gravitational effect due to a weight of the arm 230.

The linear motor 255, as illustrated, may be mounted near a top end of the hose doors 250 within the interior volume 210. Generally, the linear motor 255 may initiate opening and/or closing of the hose doors 250 upon receipt of a signal from one or more switches (such as the switches shown in FIG. 4), one or more processors, and/or one or more controllers (such as controller 110 or another controller, such as a PCB controller). In some embodiments, there may be a 1:1 ratio between hose doors 250 and linear motors 255 such that each hose door 250 is coupled to a linear motor 255. In other embodiments, alternatively, more or fewer linear motors 255 may be utilized, as appropriate.

In some embodiments, the linear motor 255 may be a linear solenoid, a linear actuator, a linear actuator assembly, or other similar device. For example, the linear motor 255 may be a device that translates a rotational energy to linear motion.

In some embodiments, the linear motor 255 may work in conjunction with a hose door spring 260 to urge the hose door 250 into the open and/or closed positions. For instance, there may be one or more hose door springs 260 coupled between each hose door 250 and the housing 205. In some cases, there may be a 1:1 ratio between hose doors 250 and hose door springs 260. In the illustrated embodiment, for example, each hose door spring 260 may urge a corresponding hose door 250 into the open and/or closed position upon an initial force applied to such hose door 250 by a corresponding linear motor 255. In other words, while the linear motor 255 may supply an initial force to initiate movement (e.g., pivotal movement) of the hose door 250 into position, the hose door spring 260 may supply a subsequent force to the hose door 250 to complete the movement of the hose door 250 into position. The hose door spring 260 may, therefore, be at a fully or substantially compressed length when the hose door 250 is at a fully closed or fully open position and a fully or substantially extended length when the hose door 250 is approximately halfway between the fully open and fully closed positions.

In some embodiments of the module 200, the controller 110 may include software and/or logic encoded in circuitry to control the opening and/or closing of the hose doors 250 based on one or more of the position of the nozzle door 235 and the nozzle 240. The controller may generate one or more commands based on the signals received from the one or more switches and the software and/or logic operating on such signals. The logic may, for example, include determining whether the nozzle door 235 has been moved to an open position (e.g., a raised position). In some instances, if the nozzle door 235 is detected in the open position, the linear motor 255 automatically initiates opening of the hose doors 250 based on receiving a command from the controller. Such logic may also include determining whether the nozzle 240 has been removed from the boot 245, such as, for example, when the user removes the nozzle 240 to dispense fluid. In some instances, if it is determined that the nozzle 240 has been removed from the boot 245, the hose doors 250 may be opened and/or maintained open.

In some embodiments, however, whether the hose doors 250 are opened and/or are maintained in the open position may depend on both the position of the nozzle door 235 and the position of the nozzle 240. For example, if the nozzle door 235 is open and the nozzle 240 is in the boot 245, the hose doors 250 may be opened and/or maintained in the open position by the linear motor 255 and, for example, the hose door springs 260. As another example, if the nozzle door 235 is closed and the nozzle 240 is in the boot 245, the hose doors 250 may be closed and/or kept in the closed position by the linear motor 255 and/or the hose door springs 260.

Figure 3:
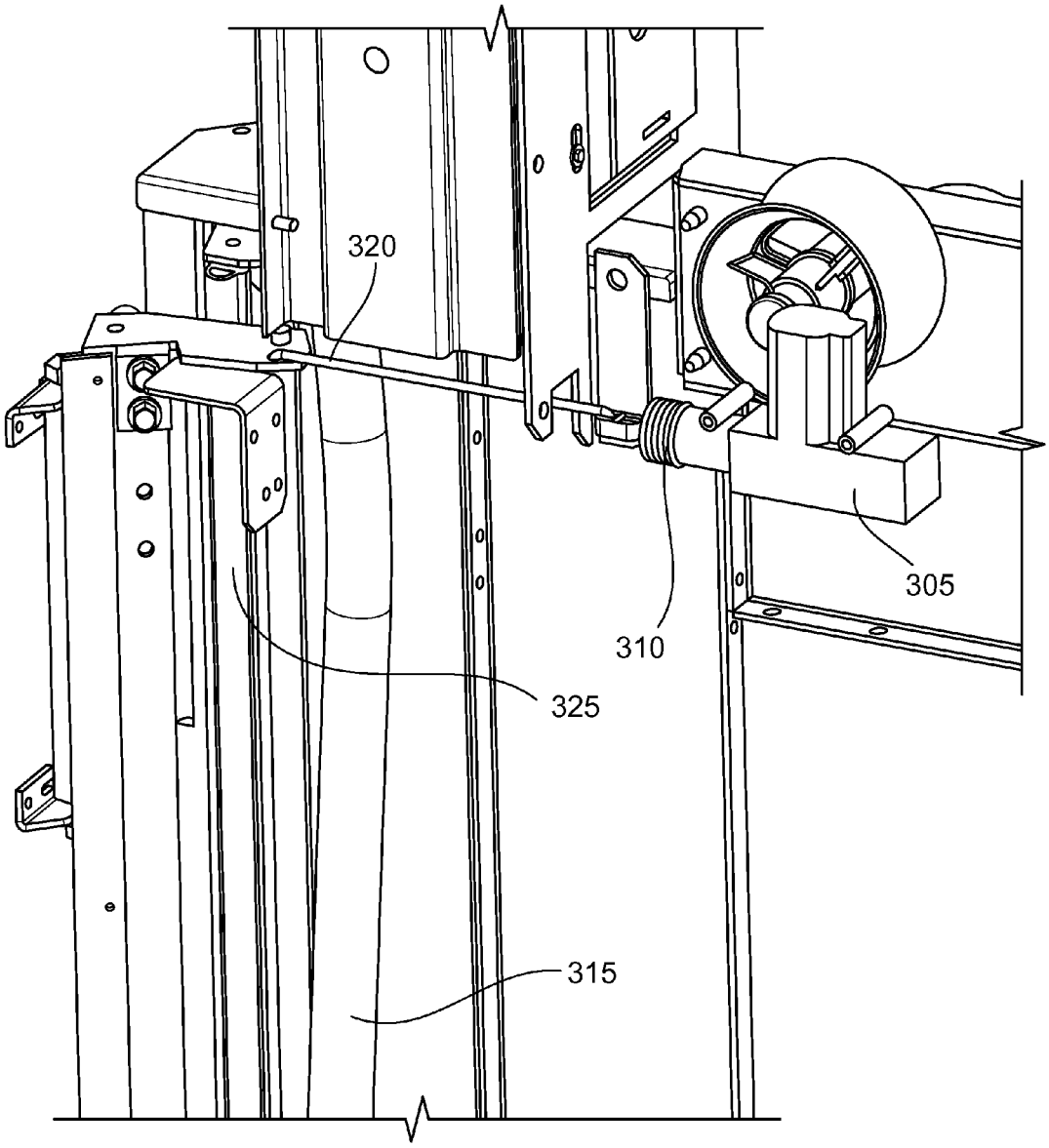
FIG. 3 illustrates a more detailed view of particular components, including a linear motor, used in opening and/or closing one or more doors of one example embodiment of a hose module according to the present disclosure.

FIG. 3 illustrates a more detailed view of particular components, including a linear motor 305, used in opening and/or closing one or more hose doors 325 of a hose module. FIG. 3 also illustrates a rod 320 coupled to the linear motor 305 and the hose door 325, a rubber bellows 310 attached to the linear motor 305 (and used for protecting an opening from which an actuating arm of the linear motor 305 extends from a casing of the linear motor 305), and a fluid hose 315. In some embodiments, the linear motor 305, the rubber bellows 310, and the rod 320 may be utilized in the hose module 120 and/or hose module 200. The linear motor 305 is attached to a housing or frame of the hose module and, generally, receives commands from one or more switches or controllers including software and/or logic to initiate opening and/or closing of the hose door 325 (illustrated in an open position, e.g., retracted). For example, the linear motor 305 may receive a command to open the hose door 325 because, for example, a fuel dispensing nozzle has been removed from a nozzle boot and/or a nozzle door has been opened. Upon receipt of such command, the linear motor 305 may initiate opening of the hose door 325 by, for example, urging the rod 320 coupled to a bracket of the hose door 325 backward towards the linear motor 305. The linear motor 305 may also receive a command to close the hose door 325 because, for example, the nozzle is seated in the nozzle boot and the nozzle door is closed. Upon receipt of such command, the linear motor 305 may initiate closing of the hose door 325 by urging the rod 320 forward.

In some embodiments, the linear motor 305 may open and/or close the hose door 325 without substantially any assistance from any other component of the hose module. In other embodiments, as described above, additional components, such as, for example, one or more hose doors springs, may assist the linear motor 305 in opening and/or closing the hose door 325 or maintaining the hose door 320 in an open and/or closed position. For example, in some embodiments, the linear motor 305 may generate a force (e.g., an extension or retraction force) for approximately 1 second, while the hose door springs may supply any additional force subsequent to such time period to urge the hose door 325 to, or maintain the hose door 325 at, an open and/or closed position.

Figure 4:
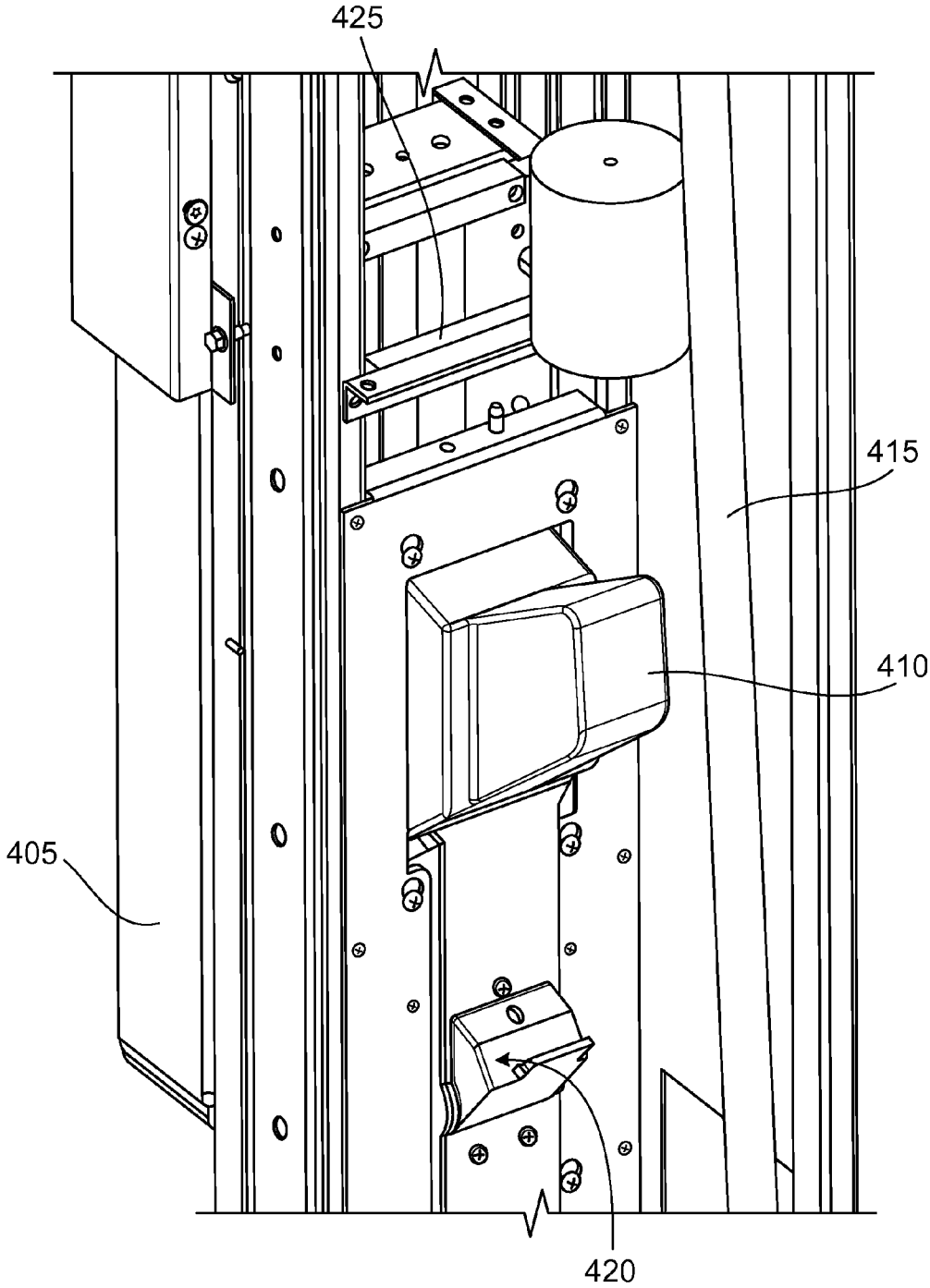
FIG. 4 illustrates a more detailed view of particular components, including one or more magnetic switches, used in opening and/or closing one or more doors of one example embodiment of a hose module according to the present disclosure.

FIG. 4 illustrates a more detailed view of particular components, including one or more magnetic switches 420 and 425, used in opening and/or closing one or more doors of a hose module. FIG. 4 illustrates a portion of a hose module (such as hose module 120 and/or 200) including the magnetic switches 420 and 425, a nozzle door 405, a nozzle boot 410, and a fluid hose 415. Generally, the magnetic switches 420 and 425 provide signals (e.g., electrical signals) to a processor, controller (such as controller 110), and/or one or more linear motors (such as linear motor 255) indicating a presence of a nozzle in the nozzle boot 410 and a position of the nozzle door 405, respectively. Such signals may be interpreted by software and/or logic encoded circuitry in determining, for example, whether to open and/or close one or more hose doors of the hose module.

The magnetic switch 420, in some embodiments, is a magnetic proximity switch that determines if the nozzle is positioned in the nozzle boot 410 (illustrated from behind in FIG. 4). For instance, a first portion of the switch 420 may be located on the nozzle while a second portion may be located in or on the nozzle boot 410. When the first and second portions of the switch 420 are in proximity, thereby indicating, for example, that the nozzle is in the nozzle boot 410, the switch 420 may energize. The switch 420, when energized, may send a signal to, for example, the controller 110, indicating the presence of the nozzle in the nozzle boot 420.

The magnetic switch 425, for example, may also be a magnetic proximity switch that determines whether the nozzle door 405 is in an open (i.e., up) or closed (i.e., down) position. The magnetic switch 425 may also include a first portion, illustrated as attached to the nozzle door 405, and a second portion, illustrated as attached to a frame or housing of the hose module. As the door 405 is adjusted from the down, or closed, position to the up, or open, position, the first portion of the switch 425 moves into proximity with the second portion of the switch 425, thereby energizing the switch 425. The switch 425, when energized, may send a signal to the controller 110 (or other component) indicating that the nozzle door 405 is in the open position.

Figure 5:
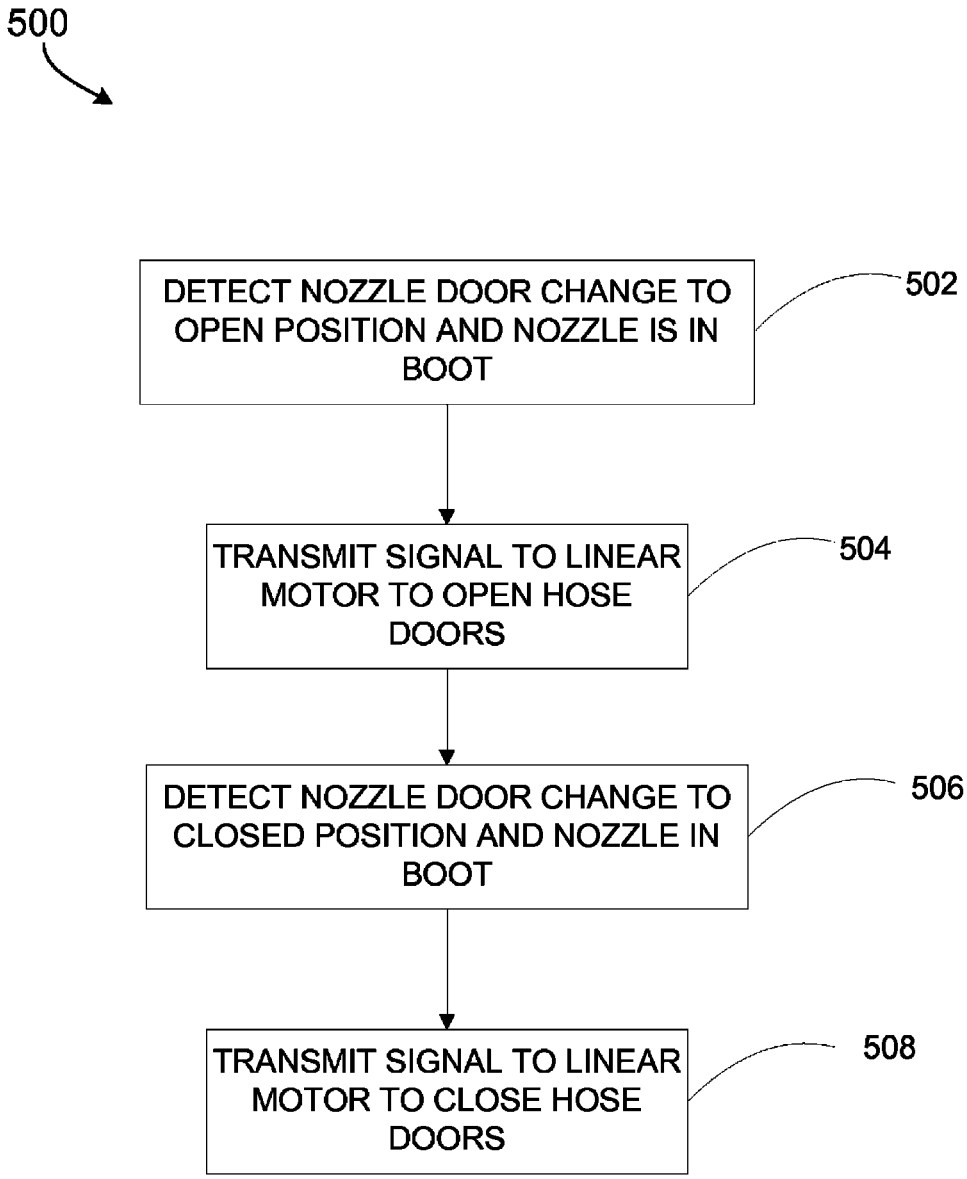
FIG. 5 illustrates an example process for operating a hose module according to the present disclosure.

FIG. 5 illustrates an example process 500 for operating a hose module, such as the hose module 120 and/or hose module 200 and hose module components, such as those illustrated in FIGS. 1-4. Process 500 may begin at step 502, when a hose module (e.g., one or more switches in a hose module) may detect a nozzle door changed to an open position and a nozzle is in a boot of the fluid dispenser. For example, as described above, a fluid dispensing customer may raise the nozzle door such that corresponding switches (or portions of a single switch) coupled to the nozzle door and/or hose module are misaligned, thereby generating a signal (e.g., electrical signal such as 4-20 mA and/or 5VDC) in the switches. Another switch (e.g., magnetic or otherwise) may be electrically coupled to the boot and detect that the nozzle is in the boot, thereby generating a signal in the switch coupled to the boot. At step 504, one or more of the signals from the switches are transmitted to a linear motor to open one or more hose doors, such as hose doors 135. As another example, signals generated by the switches may be transmitted to a controller and then to the linear motor. The signals may be consolidated, amplified, manipulated, in order to generate and transmit a separate signal (e.g., electrical signal such as 4-20 mA and/or 5VDC) to the motor.

One or more hose doors of the hose module may be opened by the motor (i.e., adjusted from a closed to a retracted or open position) based on energizing of the motor, in step 504. For example, the motor (or multiple motors, such as one motor per hose door) may be mechanically coupled to the hose doors, such as through a rod and/or piston/cylinder mechanism, in order to open the hose doors when energized. As described above, additional hose module components, such as a stored energy device (e.g., a spring) may assist the motor in opening the hose doors and/or maintaining the hose doors in an open position. Once the hose doors are in the open position, the customer may dispense fluid through the nozzle.

Upon completion of the fluid dispensing process, the customer may open the nozzle door, replace the nozzle into the boot, and close the nozzle door. Alternatively, the nozzle door may close automatically. At step 506, the hose module detects the nozzle in the boot and the nozzle door changed to a closed position. For example, the switch coupled to the boot may detect the presence of the nozzle in the boot. Alternatively, detection of the nozzle returned to the boot may cause the nozzle door to return to a closed position. Alternatively, in some embodiments, the nozzle door may automatically close (e.g., by removal of the signal to the motor and/or communication of a second signal to the motor by, for example, the controller) after the nozzle has been removed from the boot.

At step 508, a signal is transmitted to the motor to close the hose doors (i.e., adjust to the closed position). Alternatively, one or more signals generated by one or more magnetic switches coupled to the nozzle door and the boot may be transmitted to a controller and then to the linear motor. For example, the motor may be energized and return to its normal state (i.e., deenergized state), thereby closing the hose doors. Alternatively, in some embodiments, the signal to the motor (in step 504) may be a continuous signal. In such embodiments, step 508 may include discontinuing the signal to the motor that energizes the motor rather than transmitting a second signal to the controller to re-energize the motor.

Process 500 illustrates one example operation performed by one or more components of a hose module, such as the hose module 120 and/or the hose module 200 (or other hose modules described herein). Other processes or methods are contemplated by the present disclosure, including processes similar to that of process 500. For example, process 500 may include more, fewer, or different steps than those illustrated, as well as the same or different steps in a different order than that illustrated. For instance, in some embodiments, a signal may be communicated to the motor based only on detection of the nozzle door in the open position. Alternatively, a signal may be communicated to the motor based only on detection of the nozzle being removed from the boot. As another example, the signal to the motor may be stopped based only on a detection of the nozzle in the boot. Alternatively, the signal to the motor may be stopped based only on a detection of the nozzle door in the closed position.

All or a part of process 500, as well as other processes completed by the fluid dispenser, may be executed by a controller or control module executing instructions stored on tangible media, such as a memory (as described above) and/or other tangible, machine readable, and non-transitory media. In other words, process 500, and other processes, may be executable as software stored on tangible media and/or programmed into specific hardware devices (such as PLCs or other devices).

Figure 6:
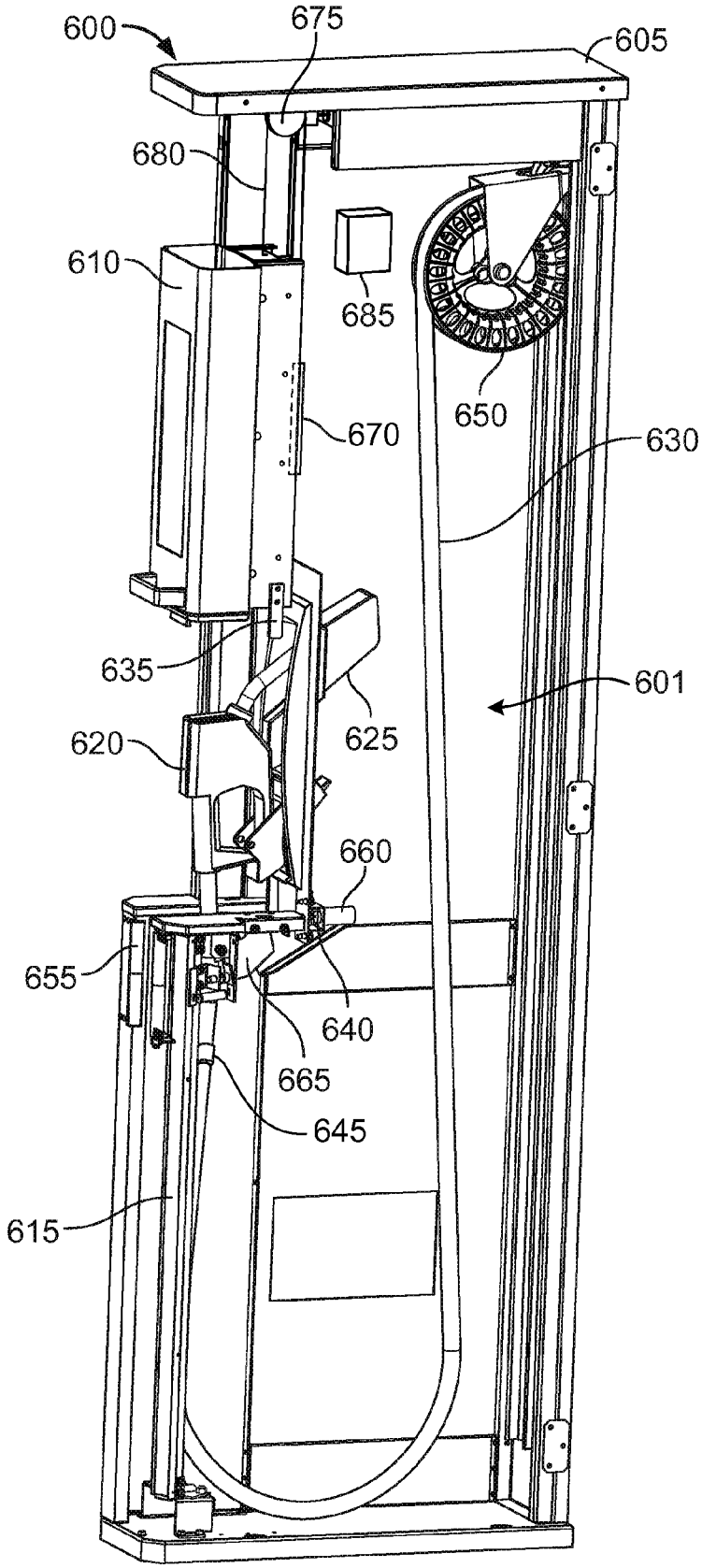
FIG. 6 illustrates a sectional view of another embodiment of a hose module according to the present disclosure.

FIG. 6 illustrates a sectional view of one embodiment of a hose module 600. In some embodiments, hose module 600 may be similar or substantially similar to the hose module 120 of the fluid dispenser 100 shown in FIG. 1. Hose module 600 includes a housing 605, a nozzle door 610 including a plunger 635, one or more hose doors 615, a nozzle 620, a nozzle boot 625, and a fluid hose 630 including a breakaway, or coupling 645. The fluid hose 630 may also include a swivel (not shown), which may be coupled to the nozzle 620 and allow for single or dual-plane rotation of the nozzle 620 to make handling of the nozzle 620 easier for the user. The hose module 600 also includes a hose pulley 650, a linear solenoid 660 with a plunge pin 640, one or more rollers 655, one or more linkages 665, a ballast 670 coupled to a ballast cord 680 over a ballast pulley 675, and an air conditioner 685. In some embodiments, the ballast 670, ballast cord 680, and ballast pulley 675 may be replaced with a spring-loaded reel to serve the same function as the ballast 670. In some embodiments, the housing 605, nozzle door 610, and hose doors 615 may be the same or similar to the corresponding components of hose module 120.

As shown in FIG. 6, nozzle door 610 includes a handle and, typically, is slideable vertically along one or more tracks or slots (not shown) integral to the housing 605. Generally, the nozzle door 610 may be adjusted upward from a closed position, in which the door 610 substantially encloses the nozzle 620 within the housing 605, to an open position, illustrated in FIG. 6. Thus, in the open position, the nozzle door 610 may allow access for the customer or user to grasp the nozzle 620 and remove it from the nozzle boot 625. One or more plungers 635 are fastened to the nozzle door 610 and, typically, protrude downward from a bottom edge of the door 610. In some embodiments, one or more plungers 635 are located on either side of the nozzle door 610. As explained more fully below, the plungers 635 disengage the linkages 665 to automatically open the hose doors 615 when the nozzle door 610 is adjusted upward to its open position. The plungers 635 also engage the linkages 665 to automatically close the hose doors 615 when the nozzle door 610 is adjusted downward to its closed position.

The hose doors 615, typically, are pivotable into the interior volume 601 to a retracted position thus allowing access to the fluid hose 630. For instance, each hose door 615 may engage a rotatable pin structure at the top and/or bottom of the door 615, thus allowing the door 615 to swing open when the nozzle door 610 is adjusted to the open position. As the hose doors 615 are typically opened automatically when the nozzle door 610 is opened, the hose doors 615 may not include any handles or graspable protrusions in some embodiments, thus providing a surface that may be slightly recessed. In some aspects, the slightly recessed surface of the hose doors 615 may allow for decreased damage to the hose module 600 in a fueling environment.

One or more rollers 655 may be located adjacent each hose door 615 and located on the exterior of the housing 605. The rollers 655, typically, may be substantially cylindrical in shape and freely rotatable. In some embodiments, the rollers 655 may extend the entire height of the hose doors 615, or alternatively, may extend only a portion of the height of the doors 615. The rollers 655 also may allow the customer or user to more easily manage and extend the fluid hose 630 from the housing 605 at a variety of positions and angles.

The nozzle 620 is in fluid communication with the fluid hose 630 and, typically, allows the consumer or user to dispense fluid into a vehicle, storage container, or other appropriate location while controlling a volumetric flow rate of the dispensed fluid. When not in use, the nozzle 620 may be stored in and supported by the boot 625 within the housing 605.

The fluid hose 630 is coupled to the nozzle 620 and is fluid communication with one or more fluid storage facilities (e.g., aboveground or underground storage tanks) and provides a closed path for fluid to be pumped from the storage facilities to the nozzle 620. Generally, the fluid hose 630 may be extended from the housing 605 through the retracted hose doors 615 once the nozzle door 610 has been adjusted to the open position. The fluid hose 630 may then be returned to the interior volume 601 of the housing 605 through the hose doors 615 and stored therein.

In some embodiments, such as that of FIG. 6 and others described in the present disclosure, the fluid hose 630 may consist of multiple segments of hose connected by, for instance, the coupling 645. The coupling 645 may allow one or more of the segments to be decoupled from the remaining portion of the hose 630 when, for instance, the fluid hose 630 experiences a large tensile force. For example, the customer or user may accidentally leave the nozzle 620 in the vehicle after completion of fluid dispensing and leave the fueling facility. In order to minimize damage to the hose module 600 and the components therein, the portion of the hose 630 between the coupling 645 and nozzle 620 may be automatically decoupled when the tensile force exceeds a threshold value. In some embodiments, the coupling 645 may include one or more valves or other, alternative shut-off devices, such that upon decoupling of the hose 630 at the coupling 645, fluid contained in the hose 630 does not escape the hose 630.

In certain embodiments, a hose pulley 650 helps facilitate extension of the fluid hose 630 from the housing 605. A first portion of the fluid hose 630 may be freely extendable from the housing 605 while a second portion of the hose 630 coupled to the first portion may be under a tensile force urging the second portion into the housing 605. For example, the first portion of the hose 630 may be extended by the customer or user and, if necessary, the customer may then pull an additional amount of hose 630 from the housing 605 against the tensile force applied to the second portion of the hose 630. In some embodiments, the tensile force may be applied to the second portion of hose 630 by the hose pulley 650. For instance, one or more bungee cords may be connected between the housing 605 and the hose pulley 650, thereby returning the hose pulley 650 to its original position when the hose tension is released, and thus the second portion of hose 630 into the interior volume of the cabinet 601.

The linear solenoid 660, in some embodiments, may be mounted adjacent a lower surface of the boot 625 and, upon activation, extend the plunge pin 640 toward the front of the hose module 600. The solenoid 660 may be activated according to the location of the nozzle 620 relative to the boot 625. For instance, the boot 625 may include one or more sensors (not shown) that detect whether the nozzle 620 is positioned in the boot 625. Upon detection of the removal of the nozzle 620 from the boot 625, the sensors may signal (directly or indirectly) the solenoid 660 to activate, thus extending the plunge pin 640 to prevent complete closure of the nozzle door 610 as it descends from the open position to the closed position. As more fully explained below with reference to FIGS. 8A-B, such prevention of the complete closure of the nozzle door 610 may prevent complete closure of the hose doors 615. Upon positioning of the nozzle 620 into the boot 625 (e.g., after a fluid dispensing operation has been completed), the sensors may signal the solenoid 660 to deactivate, thereby retracting the plunge pin 640 and allowing the nozzle door 610 to completely close.

More specifically, in some embodiments, the one or more sensors may be a magnetic sensor that, upon detection of removal of the nozzle 620 from the boot 625, close a switch to transmit a signal to a controller or microprocessor. For example, the magnetic sensor may close a switch to signal the controller 110 and/or one or more of the processors therein. The controller 110 may then energize the solenoid 660 to extend the plunge pin 640. Turning to FIG. 7C, in some embodiments, a bracket 902 may be directly coupled to the linear solenoid 660 and extend into the path of the nozzle door 610 upon energizing of the solenoid 660, thereby preventing the nozzle door 610 from fully returning to the closed position. The bracket 902 may be pivoted to its extended position, as shown in this figure, such that an opposing bracket (not shown) mounted at or near the top of the nozzle door 610 (or where appropriate) lands on the bracket 902 as the nozzle door 610 returns to its closed position. More specifically, the bracket 902 may pivot (e.g., rotates clockwise) about a shoulder bolt 906*a* with a second shoulder bolt 906*b* serving as a stop mechanism to the bracket 902 as it pivots about the bolt 906*a*. As illustrated in FIG. 7C, such embodiments may include the solenoid 660 mounted above the nozzle boot 625 rather than below the boot 625. As the door 610 may be prevented from returning to its closed position by the bracket 902, the nozzle door 610 may not engage one or more linkages 665 (shown in FIGS. 8A-B) to thereby close the hose doors 615. The bracket 902, further, may be a spring-loaded bracket with a spring 904. Upon deenergizing of the solenoid 660, the spring 904 retracts the bracket 902 by pivotal motion (e.g., rotates counterclockwise) from the path of the nozzle door 610, allowing the door 610 to return to its closed position.

Alternatively, in some embodiments, the one or more sensors may be a mechanical sensor coupled to the nozzle boot 625. The mechanical sensor may, in some embodiments, be a flapper element located at a top of the boot 625 that pivots when the nozzle 620 is inserted and/or removed from the boot 625. Upon removal of the nozzle 620 from the boot 625, the mechanical flapper may pivot to close the switch to signal the controller 110. As noted above, the controller 110 or processor therein may then energize the solenoid 660 to pivotally extend the bracket 902 and prevent full closure of the nozzle door 610.

Continuing with FIG. 6, the ballast 670 may be coupled to the nozzle door 610 by a ballast cord 680. The ballast cord 680 may be wrapped around the ballast pulley 675, thus allowing the ballast 670 to exert an upward force on the nozzle door 610 that is slightly less than the weight of the door 670. In some embodiments, the ballast 670 may thus act as a counterbalance to the nozzle door 610, thereby retarding, but not fully preventing, the downward movement of the nozzle door 610 from the open to closed position once the consumer releases the door 610. As noted above, in some embodiments, the ballast 670, ballast cord 680, and the ballast pulley 675 may be replaced with a spring-loaded reel and cable connected to nozzle door 610, whereby the tension of the spring-loaded reel is used to control the descent of nozzle door 610.

The air conditioner 685 may be mounted fully within the housing 605 and condition (e.g., heat and/or cool, dehumidify and/or humidify) the interior volume 601 of the hose module 600 by, for example, recirculating air within the volume 601 and through the conditioner 685. In another embodiment, the air conditioner 685 may be mounted to an exterior surface of the housing 605 and provide conditioned (e.g., heated and/or cooled, dehumidified and/or humidified) outside air to the interior volume 601. Further, in some embodiments, the air conditioner 685 may be mounted such that a portion of the conditioner 685 is exposed to the exterior of the housing 605 while a portion of the conditioner 685 is situated within the volume 601. Thus, the air conditioner 685 may mix and/or condition outside air and recirculated air and provide the conditioned air to the interior volume 601. In some embodiments, the air conditioner 685 may include one or more fans, one or more cooling and/or heating coils (e.g., DX, hydraulic, electric, glycol, ammonia), and one or more control devices (e.g., thermostat, fan speed switch). For instance, in some embodiments, the air conditioner 685 may be controlled according to a thermostat located within the interior volume 601 in order to maintain a temperature of the interior volume 601 to a set-point temperature (e.g., substantially above a freezing- or gel-point of fluid dispensed by the nozzle 620). The air conditioned 685, alternatively, may also be mounted within the fluid dispenser 100 and use a fan to circulate the conditioned air throughout 100 and 120.

Figure 7A:
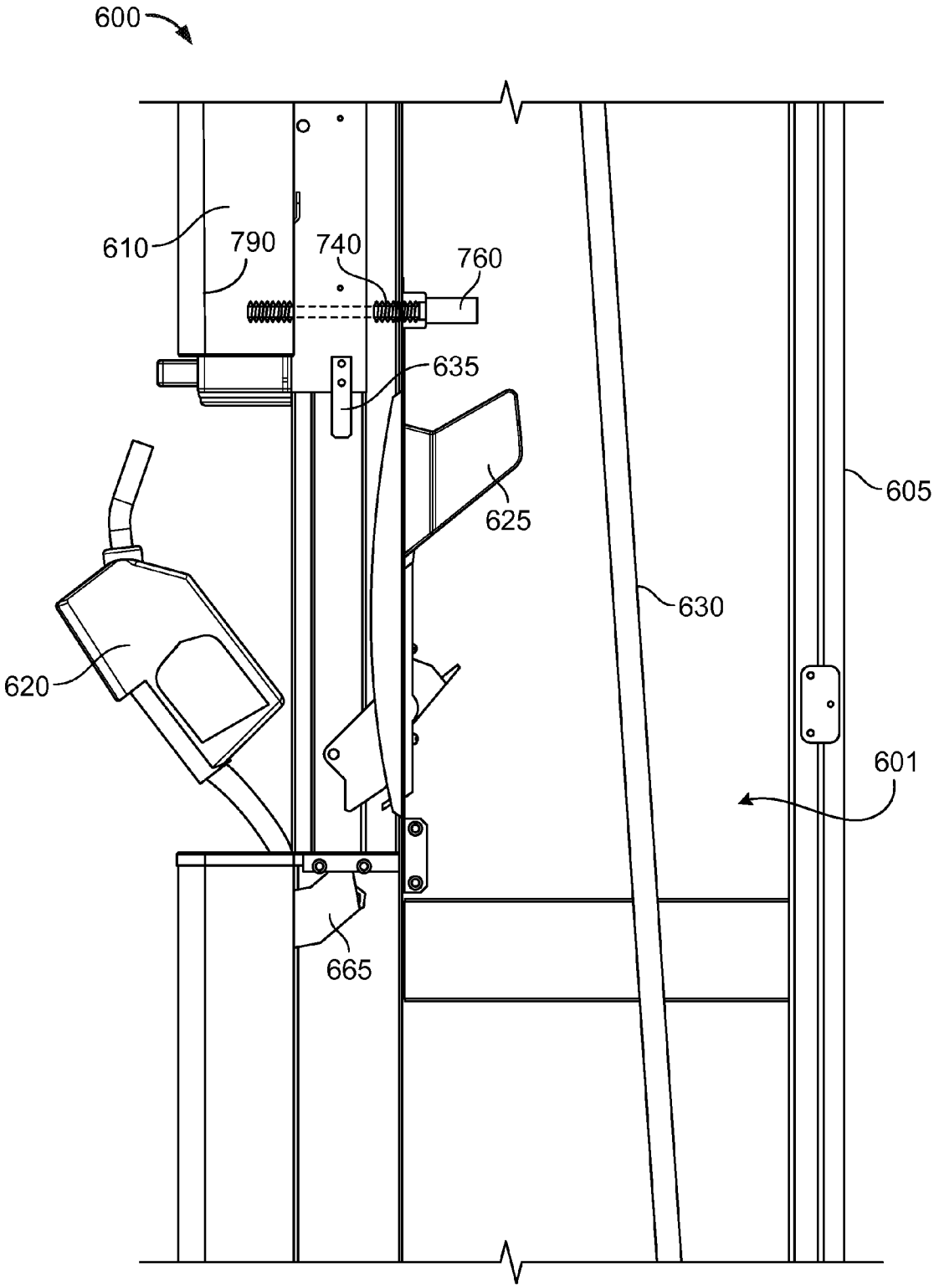
FIGS. 7A-C illustrate sectional views of an example embodiment of a hose module utilizing one technique to retain a nozzle door of the hose module in an open position according to the present disclosure.

FIG. 7A illustrates a sectional view of a portion of one embodiment of the hose module 600 including a linear solenoid 760 and a plunge pin 740. More specifically, FIG. 7A illustrates one technique to retain the nozzle door 610 of the hose module 600 in the open position utilizing the linear solenoid 760 and plunge pin 740. In some embodiments, the hose module 600 may include the linear solenoid 760 and plunge pin 740 in place of the linear solenoid 660 and plunge pin 640 described above.

Generally, the linear solenoid 760 and plunge pin 740 act cooperatively to help retain the nozzle door 610 in the open position once the consumer has raised the door 610 to access the nozzle 620. As described above, the boot 625 may include one or more sensors communicably coupled to the controller 110, the solenoid 760, or both, that detect whether the nozzle 620 is positioned in the boot 625. When the nozzle 620 is not positioned in the boot 625 (i.e., during a fluid dispensing operation), the solenoid 760 is energized by the controller 110 and extends the plunge pin 740 to come into contact with a rear surface 790 of the nozzle door 610. The plunge pin 740 thus engages the rear surface 790 and exerts a force on the nozzle door 610 directed substantially perpendicular to the surface 790. In some embodiments, the force exerted by the plunge pin 740 on the nozzle door 610 normal to the rear surface 790 generates a frictional force on the nozzle door 610 directed substantially vertical in the upward direction. Thus, in some embodiments, a sum of this frictional force and the weight of the ballast 670 may be greater than the weight of the nozzle door 610, thereby effectively retaining the nozzle door 610 in the open position during a fluid dispensing operation. Alternatively, in some embodiments, a mechanical sensor or flapper, as described above, may be coupled to the nozzle boot 625 and operate to signal the controller 110 or a processor therein upon removal of the nozzle 620 from the nozzle boot 625.

When the nozzle 620 is replaced into the boot 625, such as when the fluid dispensing operation has been completed, the sensors (mechanical and/or magnetic) may signal the controller 110 or linear solenoid 760 to deenergize, thus retracting the plunge pin 740 and removing the frictional force on the nozzle door 610. For example, upon return of the nozzle 620, the mechanical or magnetic sensor may open the switch, thereby signaling the controller 110 to deenergize the solenoid 760, which retracts the plunge pin 740. As the weight of the door 610 may be greater than the weight of the ballast 670, the nozzle door 610 may automatically return to the closed position.

Figure 7B:
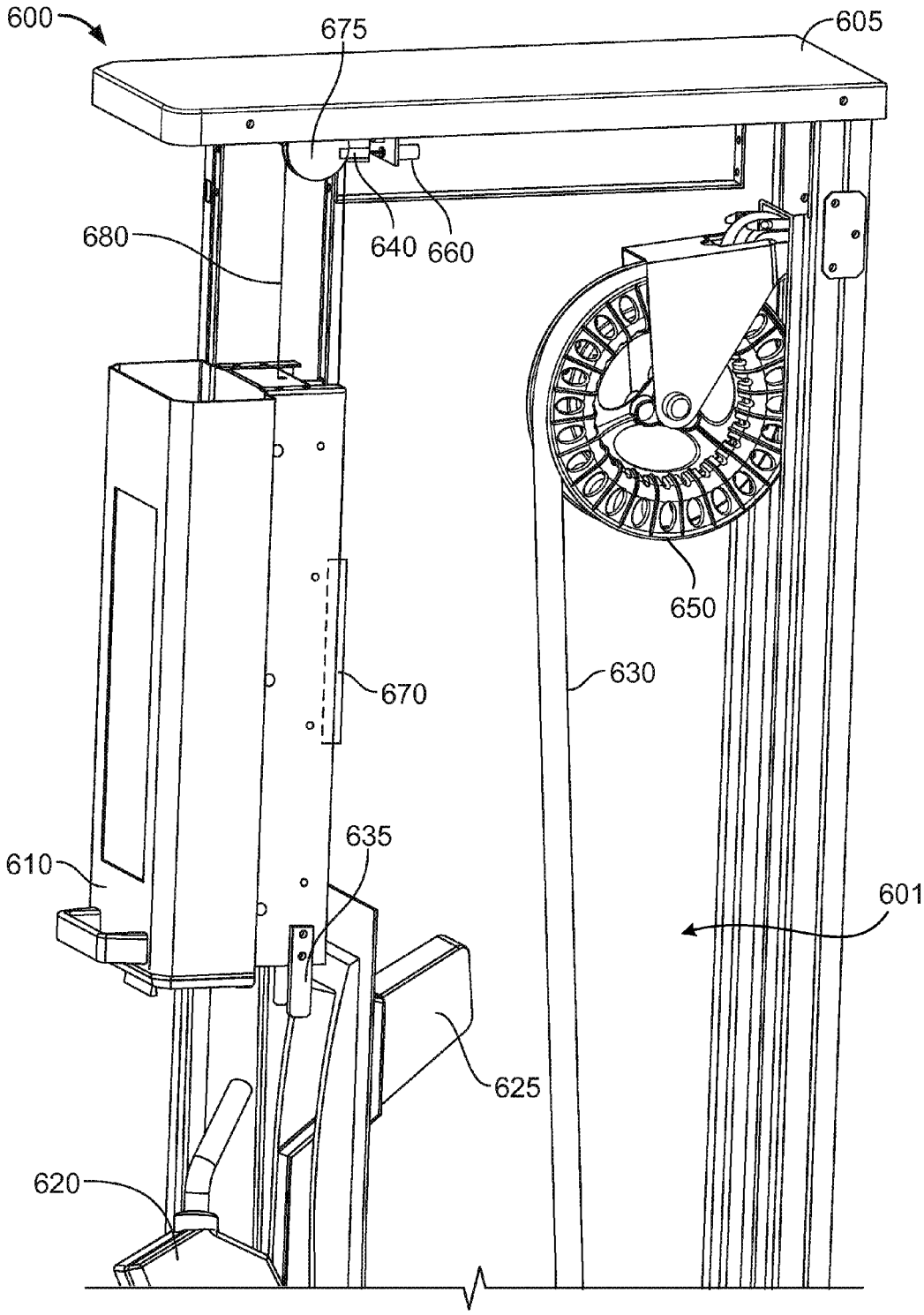
Figure 7C:
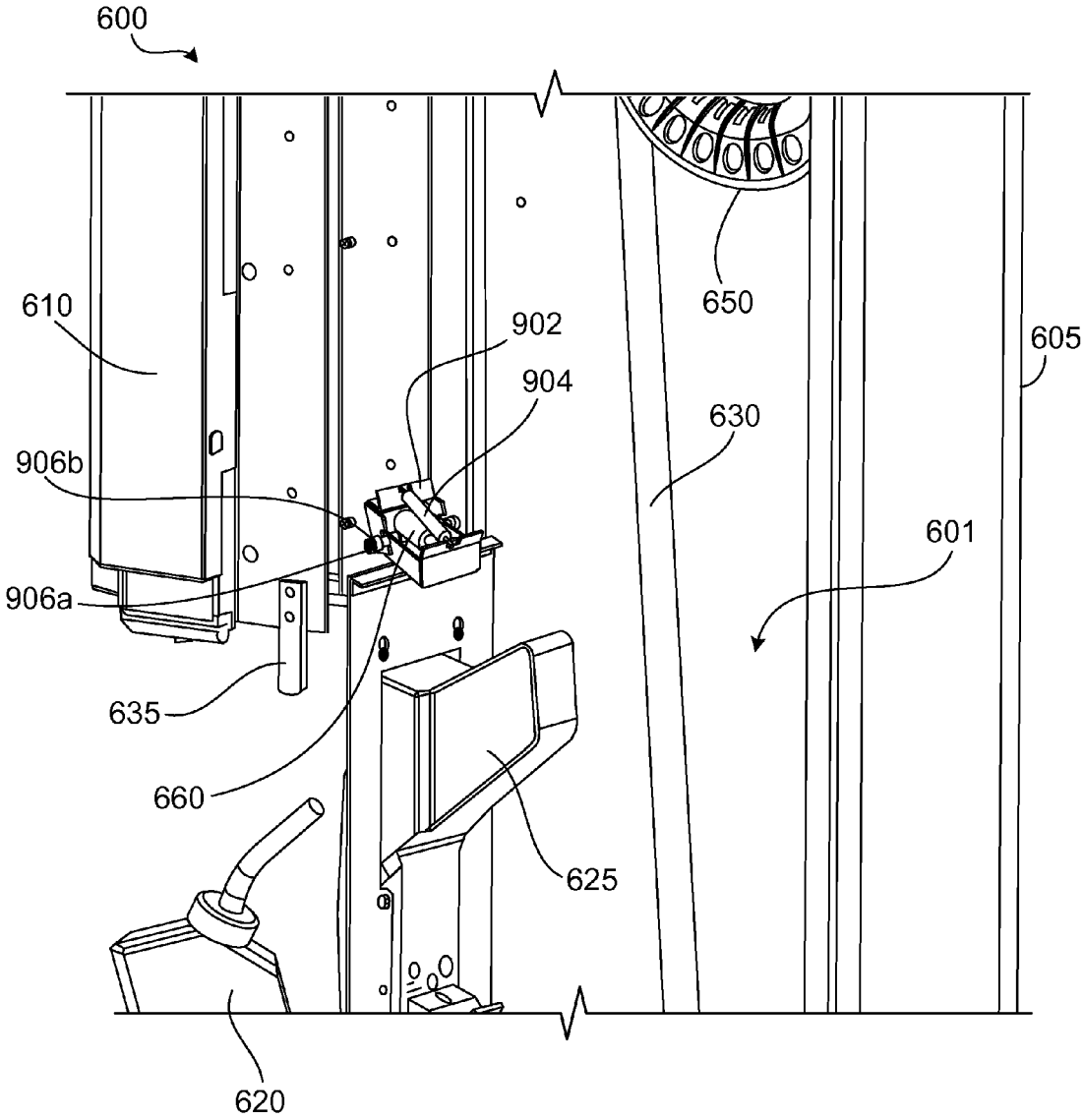

FIG. 7B illustrates a sectional view of one embodiment of a portion of the hose module 600 including a linear solenoid 860 and a plunge pin 840. FIG. 7B illustrates another technique to retain the nozzle door 610 of the hose module 600 in the open position utilizing the linear solenoid 860 and plunge pin 840. In some embodiments, the hose module 600 may include the linear solenoid 860 and plunge pin 840 in place of the linear solenoids 660 and 760 and plunge pins 640 and 740 described above.

Generally, the linear solenoid 860 and plunge pin 840 act cooperatively to help retain the nozzle door 610 in the open position once the consumer has raised the door 610 to access the nozzle 620. As described above, the boot 625 may include one or more sensors communicably coupled to the controller 110, the solenoid 760, or both, that detect whether the nozzle 620 is positioned in the boot 625. When the nozzle 620 is not positioned in the boot 625, the controller 110 may energize the solenoid 860 to extend the plunge pin 840 to come into contact with the ballast cord 680 and/or ballast pulley 675. The plunge pin 840, when extended, may thus act as a brake against the ballast cord 680 and/or ballast pulley 675, thereby generating a frictional force against the ballast cord 680 opposing the weight of the nozzle door 610. In some embodiments, a sum of the frictional force exerted by the plunge pin 840 on the ballast cord 680 and the weight of the ballast 670 may be greater than the weight of the nozzle door 610, thereby effectively retaining the nozzle door 610 in the open position during a fluid dispensing operation.

When the nozzle 620 is replaced into the boot 625, the sensors may signal the linear solenoid 860 to deenergize, thus retracting the plunge pin 840 and removing the frictional force on the ballast cord 680. As the weight of the door 610 may be greater than the weight of the ballast 670, the nozzle door 610 may automatically return to the closed position. For example, upon return of the nozzle 620, the mechanical or magnetic sensor may open the switch, thereby indicating to the controller 110 to deenergize the solenoid 860, thereby retracting the plunge pin 840 from exerting the frictional force on the ballast cord 680 and/or the ballast pulley 675.

Figure 8A:
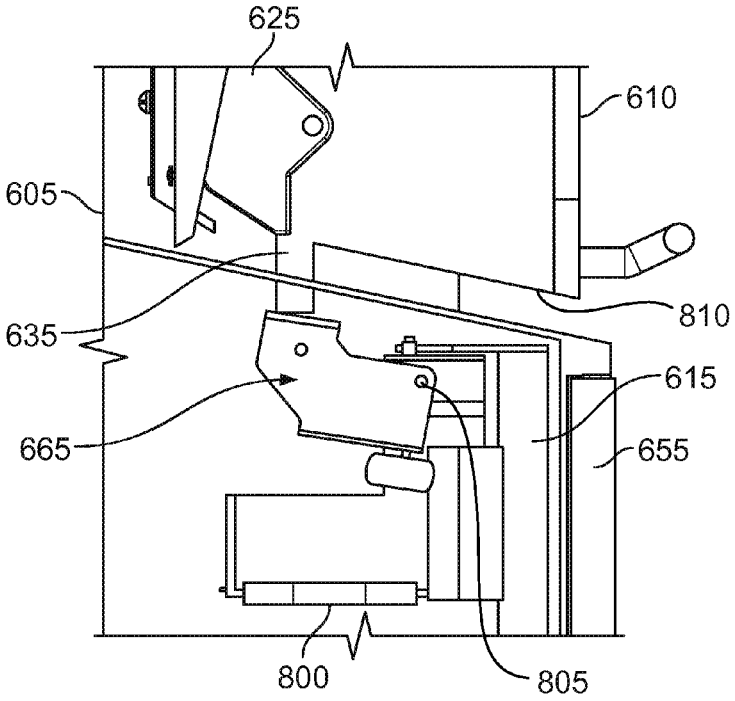
FIGS. 8A-B illustrate side views of an example embodiment of one portion of a hose module in an open position according to the present disclosure.

FIG. 8A illustrates a side view of one embodiment of a portion of the hose module 600 as the nozzle door 610 returns to the closed position from the open position. More specifically, FIG. 8A illustrates the nozzle door 610, plunger 635, one linkage 665, one hose door 615, and a door spring 800 at the moment the plunger 635 of the nozzle door 610 begins to engage the linkage 665. As will be appreciated, FIG. 8A shows only one side of a portion of the hose module 600 and a second plunger 660, linkage 665, door spring 800, and hose door 615 located on an opposed side of the hose module 600 have identical or substantially identical functionality. In some embodiments, however, the module 600 may include a single hose door 615 rather than two opposed doors. In any event, the present disclosure contemplates a single or multiple hose doors, as appropriate.

The door spring 800, generally, is coupled to the linkage 665 and the hose door 615 and urges the hose door 615 into the retracted position. Thus, when the nozzle door 610 is in the open position and the plunger 635 is not engaged (e.g., in contact) with the linkage 665, the door spring 800 operates to retain the hose door 615 in the retracted position. The linkage 665 is also coupled to the hose door 615 at a pivot 805 and may freely rotate about the pivot 805 as the hose door 615 is adjusted between the retracted position and the shut position.

As the plunger 635 engages the linkage 665, the linkage 665 rotates counterclockwise about the pivot 805, thereby extending the door spring 800 from a compressed state. As the nozzle door 610 is raised to the open position (as shown in FIGS. 7A-B) and the plunger 635 disengages the linkage 665, the linkage 665 rotates clockwise and the door spring 800 returns to its compressed state, thereby opening the hose door 615 to its retracted position.

Figure 8B:
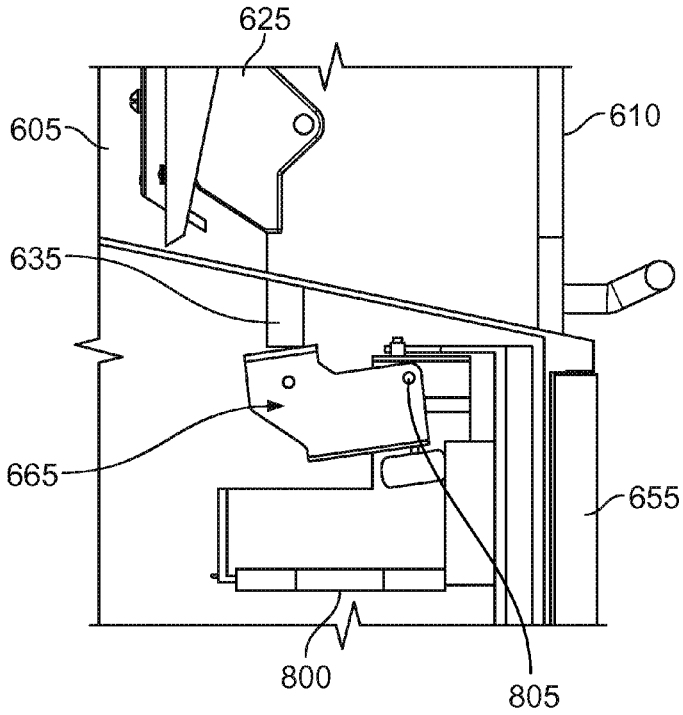

Turning now to FIG. 8B, a side view of one embodiment of a portion of the hose module 600 with the nozzle door 610 in the closed position is shown. Once the nozzle door 610 slides downward to its closed position, the plunger 635 fully engages the linkage 665, thereby extending the door spring 800 and closing the hose door 615. In some embodiments, the weight of the nozzle door 610 is greater than a spring force of the door spring 800; thus the weight of the door 610 may be translated through the linkage 665 to extend the door spring 800 when the plunger 635 engages the linkage 665. Further, due to the greater weight of the nozzle door 610, the door spring 800 remains extended, and thus the hose door 615 remains in the shut position, when the nozzle door 610 is in the closed position.

In some embodiments, one or more flexible gaskets 810 (e.g., neoprene, plastic, nylon, rubber) may be attached to the bottom surface of the nozzle door 610, thereby providing a more effective seal when the door 610 is in the closed position. Alternatively, gaskets may be located on the housing 605 at the interface of the housing 605 and the nozzle door 610. Further, one or more gaskets may be provided on the hose doors 615 or an interface between the housing 605 and the hose doors 615 to more effectively seal the housing 605 when the hose doors 615 are in the shut position.

A number of embodiments of the fluid dispenser including a hose module have been described, and several others have been mentioned or suggested. Other embodiments are within the scope of the disclosure and claims. For example, more or fewer magnetic switches may be utilized. In addition, switches other than magnetic switches may be utilized. As another example, a hose module according to the present disclosure may include one or more piston-type dampers that may retain or help retain a nozzle door in a closed and/or open position. For instance, the dampers may be "gas spring" type dampers or may be a hydraulic damper, operable to retard movement (e.g., vertical movement) of the nozzle door. As another example, a motorized device other than a linear motor may be utilized, where appropriate. Some of the advantages of the fluid dispenser have been discussed in the summary of this disclosure. Furthermore, those skilled in the art will readily recognize additional advantages that a variety of additions, deletions, alterations, and substitutions may be made to these embodiments while still achieving fluid dispensing with a fluid dispenser including a hose module described herein.

The invention claimed is:

1. A fluid dispenser comprising:

a control module operable to receive at least one command to dispense a fluid and, in response to the command, dispense fluid through a fluid nozzle; and a hose module comprising:

a housing adapted to enclose the fluid nozzle and at least a portion of a fluid hose within an interior volume of the housing, the fluid nozzle supported by a boot when enclosed within the housing;

a first door located adjacent an exterior of the housing and allowing removal of the fluid nozzle from the boot through a first opening created when the first door is adjusted from a closed position to an open position;

a second door adjacent the exterior of the housing and adjustable from a shut position to a retracted position, the second door allowing access to the fluid hose when the second door is in the retracted position; and a linear motor adapted to adjust the second door from the shut position to the retracted position based on a received signal indicating the first door in the open position.

2. The fluid dispenser of claim 1, wherein the linear motor is adapted to adjust the second door from the shut position to the retracted position based on one or more received signals indicating the first door in the open position and the nozzle removed from the boot.

3. The fluid dispenser of claim 1, wherein the linear motor is adapted to adjust the second door from the retracted position to the shut position based on a second received signal indicating the first door in the closed position and the fluid nozzle supported by the boot.

4. The fluid dispenser of claim 1, wherein the linear motor is a first linear motor, and the hose module further comprises a second motor and a third door adjacent the exterior of the housing and adjustable from a shut position to a retracted position, the third door allowing access to the fluid hose when the third door is in the retracted position, wherein the second motor is adapted to adjust the third door from the shut position to the retracted position based on the received signal indicating at least one of the first door in the open position and the fluid nozzle removed from the boot.

5. The fluid dispenser of claim 4, wherein the first and second motors comprise one linear motor.

6. The fluid dispenser of claim 4, wherein at least one of the first, second, and third doors comprise a portion of the exterior of the housing.

7. The fluid dispenser of claim 1, wherein the linear motor comprises a linear actuator assembly.

8. The fluid dispenser of claim 1, wherein the hose module further comprises:

a first switch coupled to the first door and communicably coupled to the linear motor, the first switch adapted to generate a first signal indicating adjustment of the first door from the closed position to the open position.

9. The fluid dispenser of claim 8, wherein the hose module further comprises:

a second switch coupled to the boot and communicably coupled to the linear motor, the second switch adapted to generate a second signal indicating removal of the nozzle from the boot.

10. The fluid dispenser of claim 9, wherein the received signal is at least one of the first and second generated signals.

11. The fluid dispenser of claim 9, wherein the dispenser further comprises a controller communicably coupled to at least one of the first and second switches and the linear motor.

12. The fluid dispenser of claim 11, wherein the controller is adapted to receive at least one of the first and second generated signals and transmit the received signal to the linear motor.

13. The fluid dispenser of claim 12, wherein the controller is adapted to maintain the transmission of the received signal to the motor based on substantially continuous receipt of at least one of the first and second signals.

14. The fluid dispenser of claim 12, wherein the controller is adapted to discontinue transmission of the received signal to the linear motor based on discontinuation of at least one of the first and second signals.

15. The fluid dispenser of claim 14, wherein the linear motor is adapted to adjust the second door from the retracted position to the shut position based on discontinuation of the transmission of the received signal to the linear motor.

16. The fluid dispenser of claim 12, wherein the controller and the control module are the same.

17. The fluid dispenser of claim 1, the fluid hose adapted to carry a fluid, wherein the fluid comprises an aqueous urea solution.

18. A method for dispensing fluid with a fluid dispenser comprising a control module and a hose module including a housing enclosing at least a portion of a fluid conduit, a first door, a second door, and a linear motor, the method comprising:

receiving a command at the control module to commence fluid dispensing;

generating an electrical signal based on at least one of the first door adjusted from a shut position to an open position and a fluid nozzle enclosed within the housing being supported by a boot, the boot adapted to support the nozzle in an interior volume of the housing;

energizing the linear motor based on the electrical signal; and operating the linear motor to adjust the second door from a shut position to a retracted position, the portion of the fluid conduit extendable from the housing when the second door is in the retracted position.

19. The method of claim 18, further comprising:

generating a second electrical signal based on at least one of the first door being adjusted from the open position to the shut position and the nozzle supported in the boot;

energizing the linear motor, based on the second electrical signal; and operating the linear motor to adjust the second door from the retracted position to the shut position.

20. The method of claim 18, wherein the hose module further comprises a first switch coupled to the first door and communicably coupled to the linear motor, the method further comprising: generating, by the first switch, a first signal indicating adjustment of the first door from the closed position to the open position.

21. The method of claim 20, wherein the hose module further comprises a second switch coupled to the boot and communicably coupled to the linear motor, the method further comprising:

generating, by the second switch, a second signal indicating removal of the nozzle from the boot.

22. The method of claim 21, wherein receiving, at the linear motor, the electrical signal comprises receiving, at the linear motor, at least one of the first and second generated signals.

23. The method of claim 21, wherein the dispenser further comprises a controller communicably coupled to at least one of the first and second switches and the linear motor, the method further comprising:

receiving at least one of the first and second generated signals at the controller; and transmitting the electrical signal to the motor from the controller based on receipt of the at least one of the first and second generated signals.

24. The method of claim 23, further comprising:

maintaining the transmission of the electrical signal to the linear motor based on substantially continuous receipt of at least one of the first and second signals.

25. The method of claim 23, further comprising:

discontinuing transmission of the electrical signal to the linear motor based on discontinuation of the at least one of the first and second signals.

26. The method of claim 25, further comprising:

operating the linear motor to adjust the second door from the retracted position to the shut position based on discontinuation of the transmission of the electrical signal to the linear motor.

* * * * *